US010262647B1

(12) United States Patent
Xiong et al.

(10) Patent No.: US 10,262,647 B1
(45) Date of Patent: Apr. 16, 2019

(54) CLIPPABLE MULTI-TONE WHISTLE

(71) Applicant: Touching Design LLC, Sunnyvale, CA (US)

(72) Inventors: Dan Xiong, Sunnyvale, CA (US); Haoyu Feng, Sunnyvale, CA (US); Jinyao Feng, Sunnyvale, CA (US)

(73) Assignee: Touching Design LLC, Sunnyvale, CA (US)

( * ) Notice: Subject to any disclaimer, the term of this patent is extended or adjusted under 35 U.S.C. 154(b) by 0 days.

(21) Appl. No.: 15/888,677

(22) Filed: Feb. 5, 2018

Related U.S. Application Data

(63) Continuation-in-part of application No. 29/635,919, filed on Feb. 5, 2018.

(30) Foreign Application Priority Data

Nov. 9, 2017 (CN) ..... 2017 3 0550251

(51) Int. Cl.

| | |
|---|---|
| ***A62B 3/00*** | (2006.01) |
| ***F23Q 1/06*** | (2006.01) |
| ***G10K 5/00*** | (2006.01) |
| ***B43K 25/02*** | (2006.01) |
| ***B43K 29/00*** | (2006.01) |
| ***B43K 29/18*** | (2006.01) |

(52) U.S. Cl.
CPC ..... *G10K 5/00* (2013.01); *A62B 3/00* (2013.01); *B43K 25/02* (2013.01); *B43K 29/004* (2013.01); *B43K 29/005* (2013.01); *B43K 29/18* (2013.01); *F23Q 1/06* (2013.01)

(58) Field of Classification Search
CPC ..... G10K 5/00; A62B 3/00; B43K 25/02; B43K 29/004; B43K 29/005; B43K 29/18; F23Q 1/06
USPC ..... 116/2, 137 R, 140
See application file for complete search history.

(56) References Cited

U.S. PATENT DOCUMENTS

| | | | | | |
|---|---|---|---|---|---|
| 143,044 | A * | 9/1873 | Waters | G10K 5/00 | 446/206 |
| 632,184 | A * | 8/1899 | Johnson | G10K 5/00 | 446/206 |
| 1,688,349 | A * | 10/1928 | Petrie | G10K 5/00 | 446/26 |
| 3,120,213 | A * | 2/1964 | Mulligan | A63B 71/0672 | 116/137 R |
| 3,448,541 | A * | 6/1969 | Barlow | A63H 5/00 | 401/195 |

(Continued)

*Primary Examiner* — R. A. Smith
*Assistant Examiner* — Tania Courson

(57) ABSTRACT

Example clippable multi-tone whistles, as well as systems and methods for manufacturing the same are described. An example clippable multi-tone whistle may comprise: a clip attached to a whistle body. The whistle body comprises a flat surface under the clip; a first opening configured to allow air flow to come into the whistle body; and on the flat surface a second opening configured to allow air flow to come out of the whistle body. The second opening is at least partially blocked by the clip, which controls direction of one or more air flows coming out of the second opening. The whistle part is configured to generate a plurality of different sound tones in accordance with user finger movements around the clip and the second opening. The whistle may further comprise a glass breaker, a length scale, and a bolt action switch, which may function as a fire starter.

20 Claims, 7 Drawing Sheets

(56) References Cited

U.S. PATENT DOCUMENTS

| | | | | | |
|---|---|---|---|---|---|
| 4,343,490 | A * | 8/1982 | Adamson | A63C 11/222 | 219/201 |
| 4,522,584 | A * | 6/1985 | Crespy | F23Q 2/32 | 30/459 |
| D301,513 | S * | 6/1989 | Wright | D10/119.3 | |
| 5,318,492 | A * | 6/1994 | Quinn | A63B 21/072 | 222/175 |
| 5,735,621 | A * | 4/1998 | Shih | B43K 23/12 | 401/131 |
| 7,176,367 | B2 * | 2/2007 | Yeh | B43K 29/00 | 116/137 R |
| D692,480 | S * | 10/2013 | Chu | D19/123 | |
| 8,967,899 | B1 * | 3/2015 | Chu | B43K 29/16 | 401/195 |
| D746,922 | S * | 1/2016 | Chu | D19/123 | |
| 9,659,554 | B1 * | 5/2017 | Determan | G10K 5/00 | |
| 2008/0075523 | A1 * | 3/2008 | Chen | B43K 5/005 | 401/195 |
| 2010/0080087 | A1 * | 4/2010 | Shupp | G01C 17/00 | 368/14 |
| 2017/0355086 | A1 * | 12/2017 | Lee | B26B 11/001 | |

* cited by examiner

CLIPPABLE MULTI-TONE WHISTLE

CROSS REFERENCE TO RELATED APPLICATIONS

This application is a continuation-in-part of U.S. Design patent application Ser. No. 29/635,919, filed Feb. 5, 2018 and entitled "Clipable Whistle Pen," which claims priority to China Design Patent Application No. 2017305502511, filed Nov. 9, 2017, entitled "pen." All above-identified patent applications are hereby incorporated by reference in their entireties.

TECHNICAL FIELD

The present disclosure generally relates to an outdoor activity gadget and more specifically to a clippable multi-tone whistle.

BACKGROUND

Whistle is a useful gadget in outdoor activities. It can be a life-saving tool for adventurers in wilderness to grab attention from rescuers or teammates. A traditional whistle produces a monotone high-pitched sound to alert rescuers or teammates. However, a monotone whistling sound can easily become lost in the wind and diminished by other sounds in the wilderness. In addition, a traditional whistle made as a standalone gadget is hard to be combined with other useful life-saving tools to form a compact, but multi-purpose, tool for adventurers to carry and use.

Figure 1:
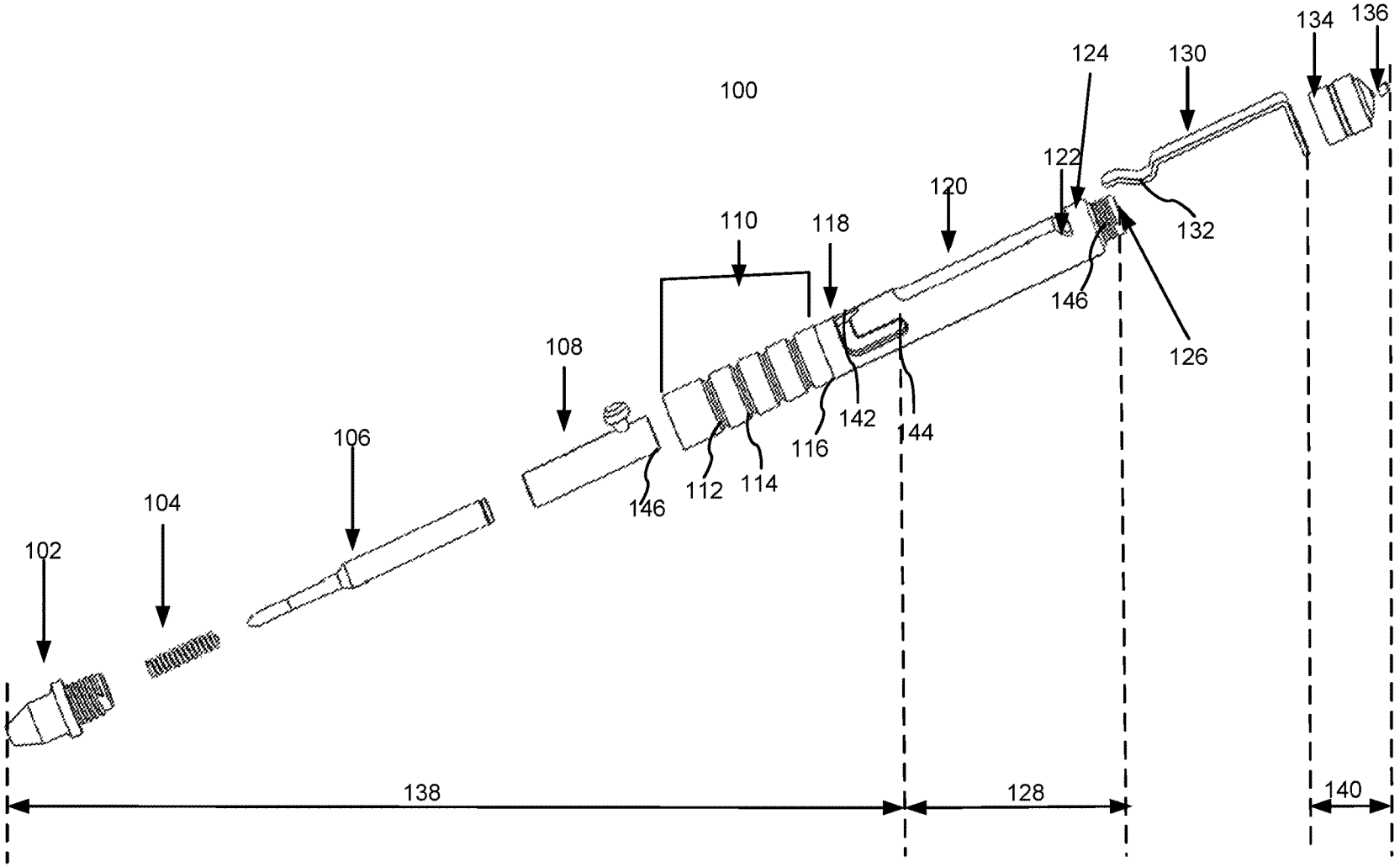
FIG. 1 is a block diagram illustrating a perspective view of an example clippable multi-tone whistle.

Embodiments of the present disclosure and their advantages are best understood by referring to the detailed description that follows. It should be appreciated that like reference numerals are used to identify like elements illustrated in one or more of the figures; showings therein are for purposes of illustrating embodiments of the present disclosure and not for purposes of limiting the same.

SUMMARY

Embodiments of clippable multi-tone whistles, as well as methods and computer executable instructions for manufacturing the whistles are provided in the present disclosure.

A clippable multi-tone whistle, in some implementations, comprises: a clip attached to a whistle body. The whistle body comprises a flat surface under the clip, a first opening configured to allow air flow to come into the whistle body, and, on the flat surface, a second opening configured to allow air flow to come out of the whistle body. The second opening is at least partially blocked by the clip, which controls direction of one or more air flows coming out of the second opening. The whistle part is configured to generate a plurality of different sound tones in accordance with user finger movements around the clip and the second opening.

In some implementations, the first opening of the clippable whistle is unobstructed by the clip.

In some implementations, the second opening of the clippable whistle is under the clip.

In some implementations, the second opening is the only opening to allow the air flow to come out of the whistle body.

In some implementations, the second opening is of a wedge shape with its opening wider than the width of the clip such that the clip partially blocks the air flows coming out of the second opening. The amount and direction of unblocked air flows coming out of the second opening may be controlled by finger movements around the clip and the second opening.

In some implementations, the clip of the whistle includes a curved portion that at least partially blocks the one or more air flows coming out of the second opening to control the direction of the one or more air flows.

In some implementations, the clippable multi-tone whistle further comprises a glass breaker. The glass breaker may include a detachable tip configured in a shape that allows glass debris to be expelled away from the center of the tip during a glass breaking process. The glass breaker may also be mechanically separable from the whistle.

In some implementations, the clippable multi-tone whistle further comprises a pen. The pen may be mechanically separable from the whistle. The pen may include one or more dialed length scales on the pen's finger rest area. The dialed length scale may be machined with diamond knurling texture to balance between a solid grip and comfort.

In some implementations, the pen may apply a bolt structure to control the position of ink refill. The bolt structure may be separable from the pen and made of hard material such that it is capable of starting fire sparkles when being struck against a hard surface.

In some implementation, the whistle's surface under the clip may be configured into multiple levels such that the space between the clip and the whistle's surface is capable of forming a tight grip on edges of various thicknesses. For example, the whistle's surface around the second opening may include two levels such that the level closer to the first opening forms a narrower space with the clip's surface than the level more distant from the first opening. The narrower space allows the whistle to be clipped tight on thin edges such as the edge of a piece of paper. The wider space allows the whistle to be clipped tight on thick edges such as the edge of a jean's pocket.

A computer-implemented method for manufacturing the clippable multi-tone whistles as described in any of the implementations above.

A non-transitory computer readable medium comprising computer executable instructions stored thereon, which, when executed by one or more computers, cause a machine to manufacture the clippable multi-tone whistle as described in any of the implementations above.

DETAILED DESCRIPTION

The clippable multi-tone whistle disclosed in the present disclosure is capable of creating a loud, up to 100 dB whistle sound which is uniquely designed to be controlled by fingers and produce a variety of tones to attract others' attention. Also, the different parts of the whistle can include a pen; the whistle body can include several length scales; and the whistle bolt can be used as a fire starter. Thus, an example whistle described in the present disclosure is a multifunctional survival gadget for adventurers to carry on their sleeve pockets, notebooks, and alike.

The present disclosure provides example outdoor activity gadget, e.g., clippable multi-tone whistles, as well as systems and methods for manufacturing the same. The technologies described in the present disclosure can provide the following technical advantages. First, the clippable multi-tone whistle implementing technologies described in the present disclosure allows a user to grab attention from other persons in a wilderness environment so as to facilitate the search and rescue, as well as communications in the wilderness environment. Second, a clippable multi-tone whistle may be easily assembled with other useful tools to create a useful tool kit for outdoor activity.

Additional details of implementations are now described in relation to the Figures.

FIG. 1 is a block diagram illustrating a perspective view of an example whistle and various whistle parts.

As shown in FIG. 1, a clippable multi-tone whistle, in some implementations, includes components, each of which can be used as an outdoor survival tool. For example, a vehicle occupant may drown in a vehicle submerged in a flood. Many vehicle occupants are unable to break a vehicle window due to a lack of proper tools. A glass breaker can therefore help a vehicle occupant escape from a car in an emergency. Other desirable features of a compact survival tool kit may include a pen for noting down distress messages, a fire starter for warming body and for cooking food, and one or more length scales for providing measurements. For another example, a whistle may include a glass breaker attached to one end and a pen attached to the other end. In addition, a fire starter and length scales may also be provided as whistle parts such that a user carrying the whistle does not need to carry other tools.

FIG. 1 shows an example whistle may comprise a clip 130 and a whistle body 128 comprising a flat surface 120, a first opening 126 that allows a user to blow air into the whistle body 128 and a second opening 122 carved into the flat surface 120 that allows air to flow out of the whistle body 128.

In some implementations, the clip may include a curve structure 132 which serves at least two functions: to clip the whistle body onto an attachment such as a user's jean pocket and to at least partially block air flows coming out of the second opening 122 to control the direction of the air flows.

The whistle body 128 may, in some implementations, be extended from one end to include a detachable pen 138 and extended from the other end to include a glass breaker 140. The pen may comprise a pen tip 102, a spring 104, an ink refill 106, a bolt 108, a pen shell 110, and a bolt slot 118.

The bolt may serve three functions. First, after the pen 138 is assembled, when the bolt 108 is inserted into the bolt slot 118 and connected with the ink refill 106, the bolt 108 may push the ink refill 106 outside the pen tip 102 when the bolt 108 is positioned at 142. The bolt 108 may retrieve the ink refill 106 into the pen tip 102 when the bolt 108 is positioned at 144. Second, one end 146 of the bolt 108 is a closed end. After being inserted into the position 144 of bolt slot 118, the bolt 108 seals the whistle body 128 from one end. The seal forces all air flows coming from the first opening 126 to come out only through the second opening 122, which enable a whistle blower to create not only a loud sound, but also different tones. Third, in some implementations, the bolt 108, when made of hard material such as Magnesium, may be used as a fire starter. A whistle user may dissemble the bolt 108 from the pen 138 and strike the bolt 108 against a hard surface (e.g., a piece of metal or a stone) to start a fire. The nob on the bolt 108 allows a tight grip of the bolt 108 when starting a fire.

The pen shell 110 forms a finger resting area of the pen 138. This area may include one or more dialed length scales. For example, the distance between 112 and 116 may be machined to 1 inch and the distance between 112 and 114 may be a quarter inch to provide a convenient measuring tool, especially in a wilderness environment. In addition, the dialed length scales may be machined with diamond knurling texture to balance between comfort and solid grip.

At the other end of the whistle body 128, the glass breaker 140 comprises a breaker body 134 and a breaker tip 136. The breaker body 134 may include a cone shape end for the breaker tip 136 to mount. The breaker tip 136 may be detachable from the breaker body 134 and configured in a way to expel away glass debris from the center of the tip during glass breaking. For example, the breaker tip 136 may have a particular slope (e.g., a slope having a 15%-30% degree angle relative to the ground), so that when the breaker tip 136 hits a glass surface, glass particles are pushed away from the center of the breaker tip 136. These designs enable a user to effectively use the glass breaker without risking bodily in juries, for example, to her hand or arm.

In addition, the breaker body 134 may include screw lines inside so that the part 146 may screw through the clip 130 and screw with the breaker body to secure the glass breaker 140 onto the whistle body 128. When a user intends to blow the whistle, he may unscrew the glass breaker 140 to expose the first opening 126 and blow into it.

Figure 2C:
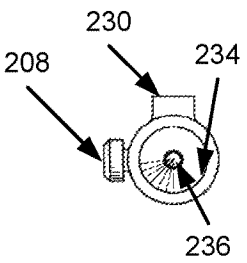
FIG. 2C is a block diagram illustrating a back view of an example clippable multi-tone whistle.
Figure 2B:
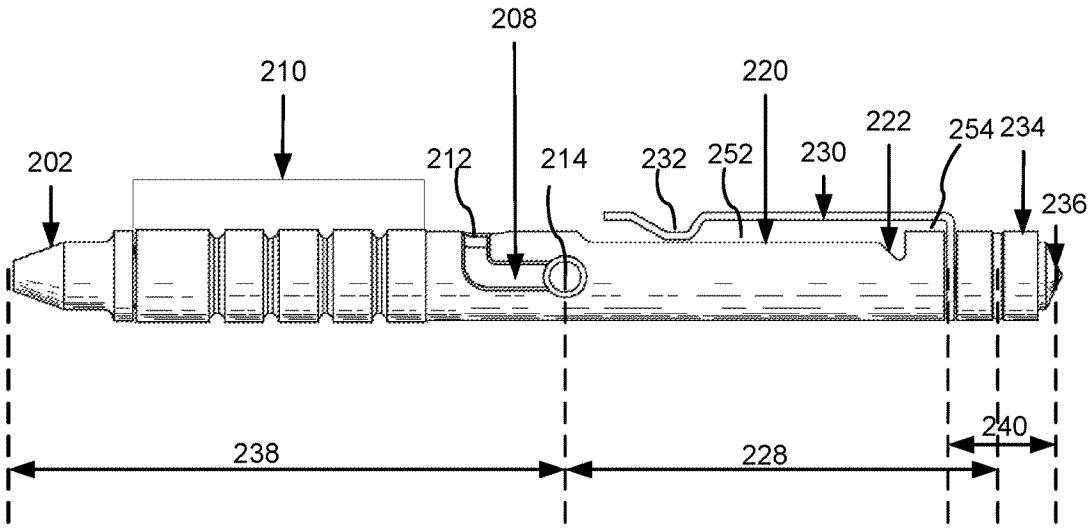
FIG. 2B is a block diagram illustrating a side view of an example clippable multi-tone whistle.
Figure 2A:
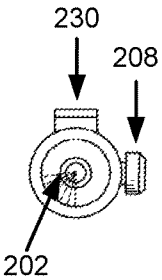
FIG. 2A is a block diagram illustrating a front view of an example clippable multi-tone whistle.

FIG. 2A is a block diagram illustrating an end view of an example whistle after being assembled with a pen 238, a fire starter 208, a length scale 210, and a glass breaker 240. The cross section of the pen's tip 202 is facing the viewer. The pen's bolt 208 is at position 214 of FIG. 2B and retrieves the pen's ink refill inside the pen tip 202.

FIG. 2B is a block diagram illustrating a side view of an example whistle after being assembled with a pen, a fire starter, a length scale, and a glass breaker. The whistle's tip is on the top of the whistle. As shown in FIG. 2, a multi-functional whistle may include a pen 238, a whistle body 228 and a glass breaker 240 after all the parts in FIG. 1 are connected in sequence. In the implementation shown in FIG. 2B, the whistle body 228 and the glass breaker 240 share a portion because the breaker body 234 serves as both a cover of the first opening of the whistle body 228 and a pedestal of the breaker tip 236. The first opening of the whistle body 228 is unobstructed by the clip 230.

FIG. 2B shows that the flat surface 220 is positioned under the clip 230. The second opening 222 is carved into the flat surface 220. The second opening 222 is at least partially blocked by the clip 230 which controls the direction of air flows coming out of the second opening. When whistle blower's finger moves around the clip 230 and the second opening 222, the figure's movement changes the direction and the amount of air flows coming out of the second opening 222 and allows the whistle body 228 to generate a plurality of different sound tones.

As shown in FIG. 2B, the second opening 222 may be carved into a wedge shape and serves as the only opening to allow the air flow to come out of the whistle body 228. The second opening 222 may be positioned under the clip 230. The clip 230 may include a curve structure 232 to at least partially block the air flow coming out of the second opening 222.

In some implementations, the flat surface 220 under the clip may include multiple levels such that the space between the clip 230 and the flat surface 220 may form a tight grip on edges of various thicknesses. For example, in the embodiment of FIG. 2B, the space 252 is higher than that of space 254. While space 252 allows the whistle body to grip tightly on thick edges, such as the edge of a jean's pocket, space 254 allows the whistle body to grip tightly on thin edges, such as the edge of several pieces of paper.

FIG. 2C is a block diagram illustrating an end view of an example whistle after being assembled with a pen 238, a fire starter 208, a length scale 210, and a glass breaker 240. The cross section of glass breaker 240 is facing the viewer. The pen's bolt 208 is at position 214 of FIG. 2B and can cause the pen's refill to retreat back inside the pen tip 202.

Figure 3C:
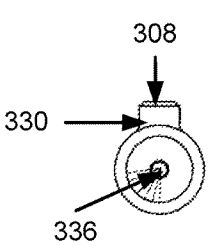
FIG. 3C is a block diagram illustrating a back view of an example clippable multi-tone whistle.
Figure 3B:
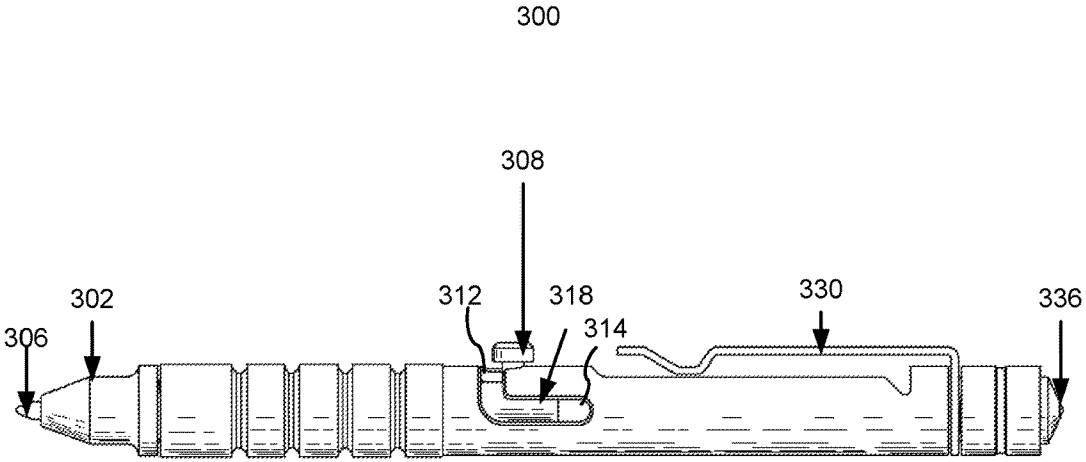
FIG. 3B is a block diagram illustrating a side view of an example clippable multi-tone whistle.
Figure 3A:
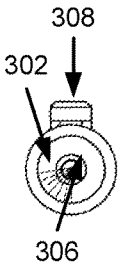
FIG. 3A is a block diagram illustrating a front view of an example clippable multi-tone whistle.

FIGS. 3A, 3B, and 3C show the same view of the whistles shown in in FIGS. 2A, 2B and 2C, respectively, except that the bolt 308 is at position 312, rather than at position 314 of the bolt slot 318. At position 312, bolt 308 pushes the pen's refill 306 outside the pen tip 302.

Figure 3D:
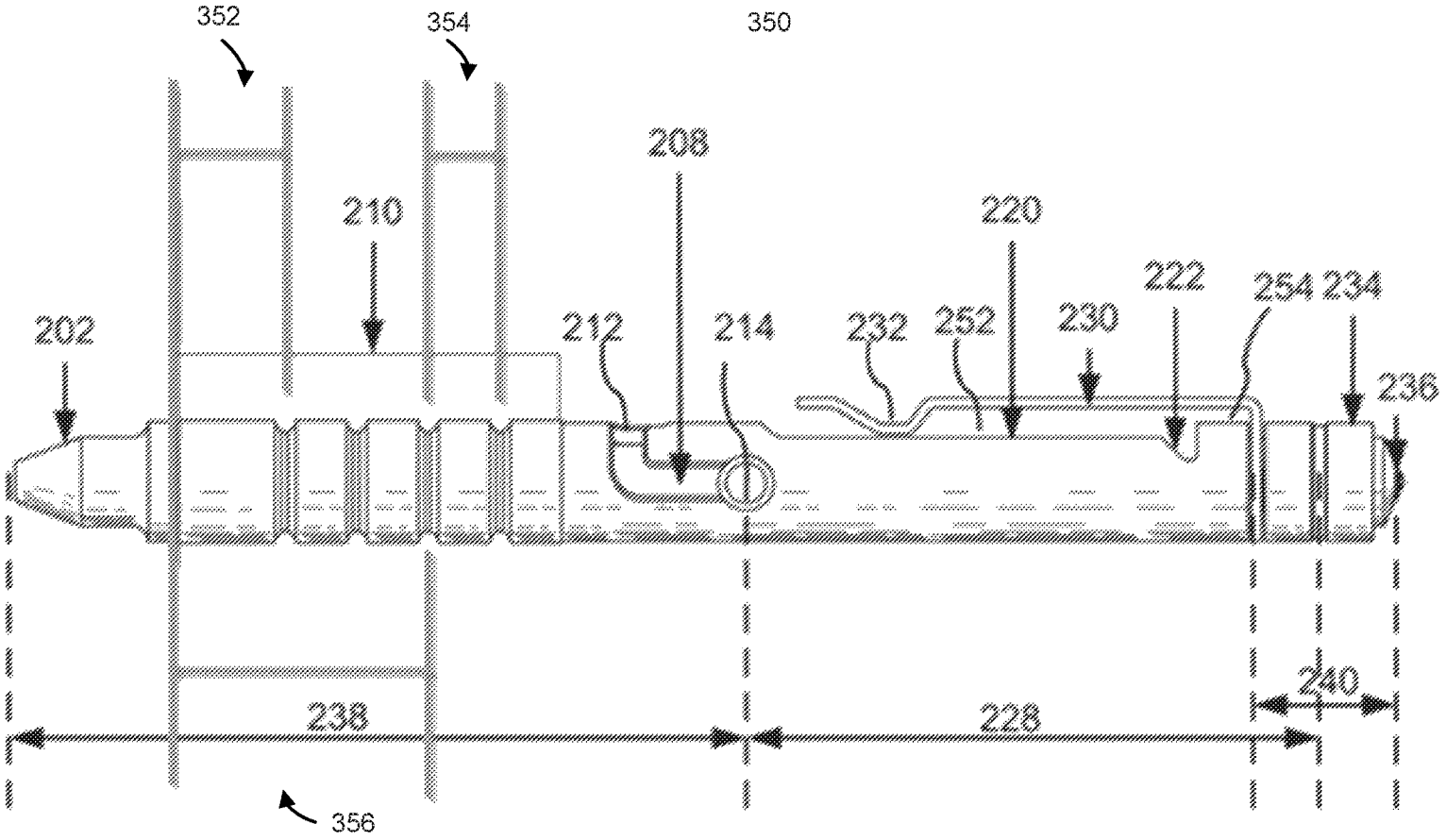
FIG. 3D is a block diagram illustrating dimensions of various components of an example clippable multi-tone whistle.

FIG. 3D is a block diagram illustrating dimensions of various components of an example clippable multi-tone whistle. For example, the widths of portions 352, 354, and 356 may be 10 mm, ⅓ inch, and 1 inch, respectively. The length of three dial portions may be equal, e.g., ⅓ inch, or different.

Figure 4:
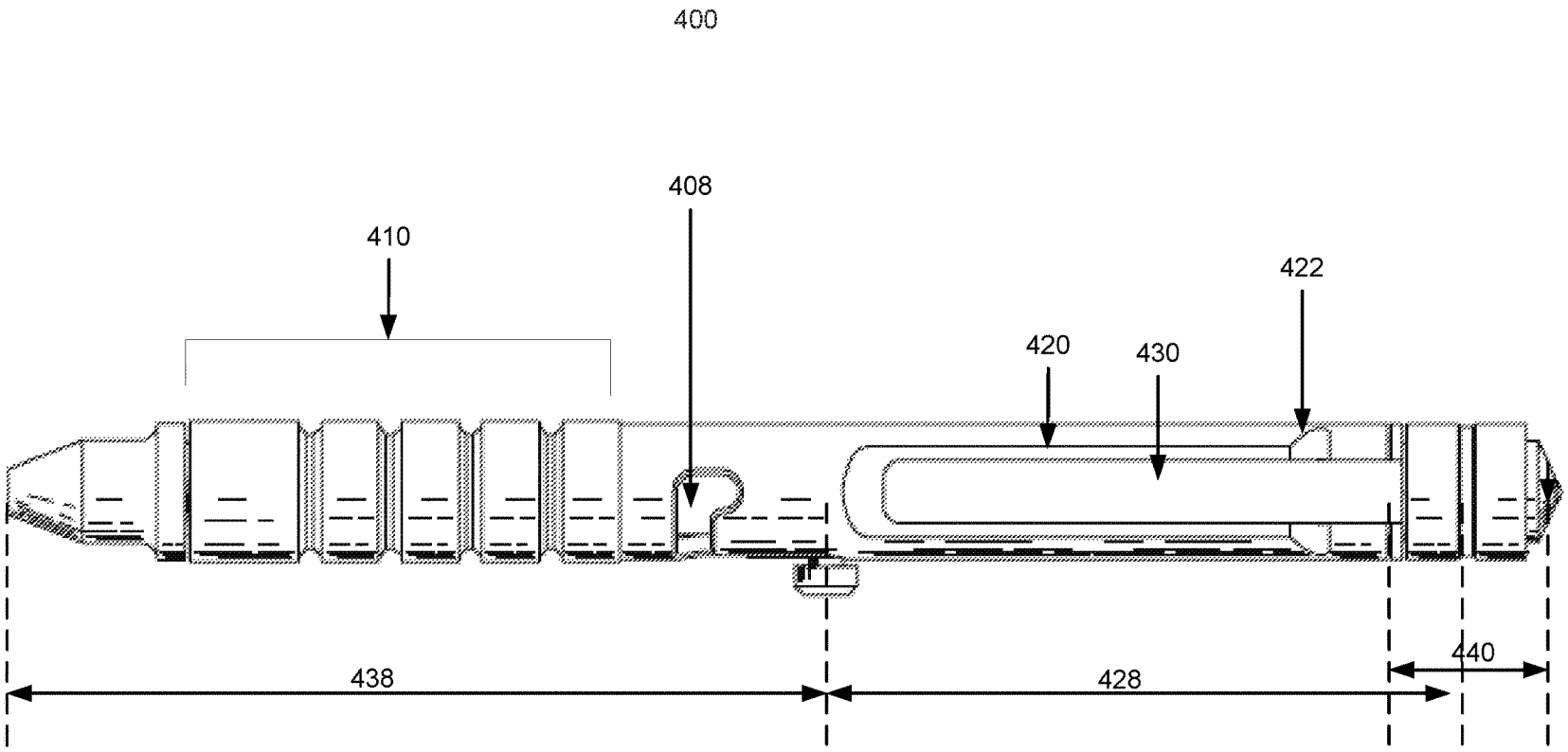
FIG. 4 is a block diagram illustrating a top view of an example clippable multi-tone whistle.

FIG. 4 is a block diagram illustrating a top view of an example whistle after the whistle body 428 is assembled with a pen 438, a fire starter 408, a length scale 410, and a glass breaker 440. The clip 430 is facing the viewer. In this implementation, the second opening 422 is wider than the width of the clip such that the air flow coming out of the second opening 422 is partially blocked by the clip 430. The amount and direction of unblocked air flow coming out of the second opening 422 can be controlled by finger movements around the clip 430 and the second opening 422.

Figure 5:
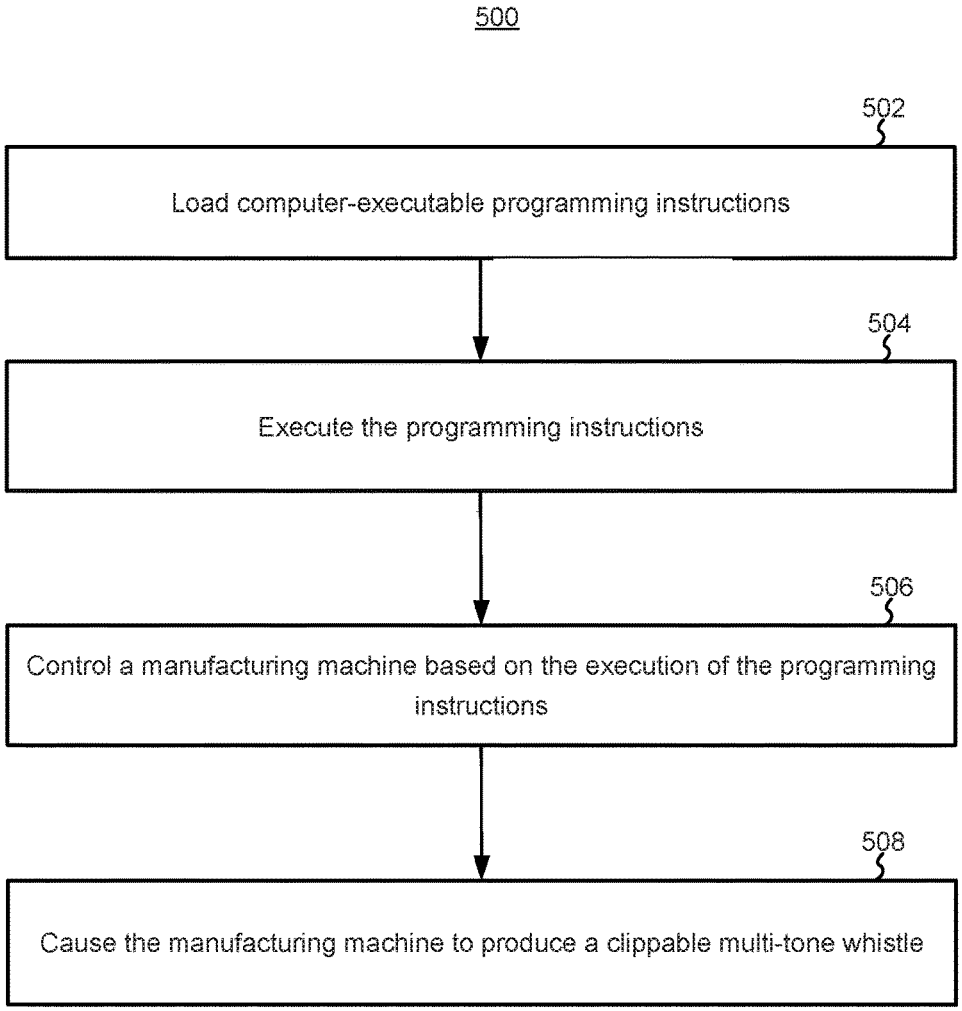
FIG. 5 is a flowchart illustrating an example method for manufacturing a clippable multi-tone whistle.

FIG. 5 is a flowchart illustrating an example computer-implemented method 500 for manufacturing clippable multi-tone whistle. The computer system 600, when properly programmed, can execute the method 600.

In some implementations, the method 500 includes using a computer to load (502) computer-executable programming instructions from a non-volatile memory of the computer to a volatile memory of the computer.

After loading the programming instructions, the computer may execute (504) the programming instructions using the volatile memory.

Based on the execution of the programming instructions, the computer may control (506) a manufacturing machine, for example, a cutting machine, a molding machine, or a pressing machine.

By controlling the manufacturing machine, the computer causes (508) the manufacturing machine to manufacture an outdoor activity gadget as described in one or more of the implementations disclosed in the present disclosure.

Figure 6:
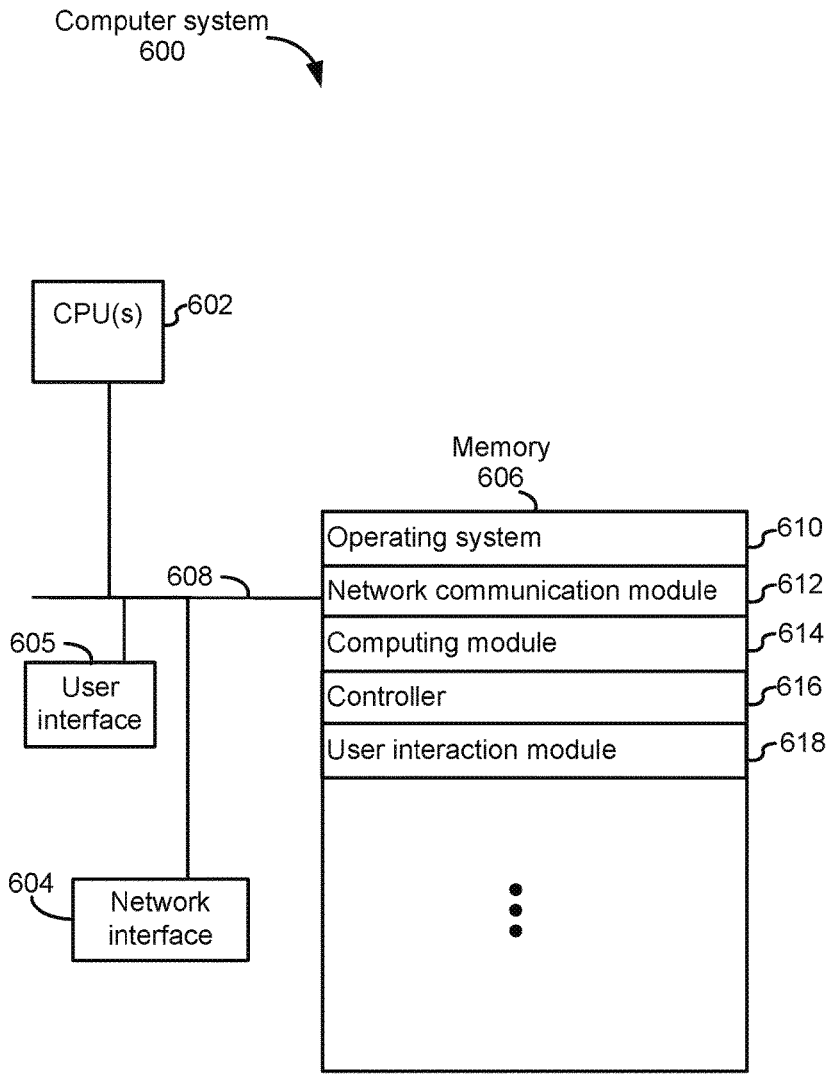
FIG. 6 is a block diagram illustrating an example computer system for manufacturing a clippable multi-tone whistle.

FIG. 6 is a block diagram illustrating an example computer system 600 for manufacturing an outdoor activity gadget. The computer system 600 in some implementations includes one or more processing units CPU(s) 602 (also referred to as processors), one or more network interfaces, optionally a user interface, a memory 606, and one or more operating systems 610 for interconnecting these components. The operating systems 610 optionally include circuitry (sometimes called a chipset) that interconnects and controls communications between system components. The memory 606 typically includes high-speed random access memory, such as DRAM, SRAM, DDR RAM or other random access solid state memory devices; and optionally includes non-volatile memory, such as one or more magnetic disk storage devices, optical disk storage devices, flash memory devices, or other non-volatile solid state storage devices. The memory 606 optionally includes one or more storage devices remotely located from the CPU(s) 602. The memory 606, or alternatively the non-volatile memory device(s) within the memory 606, comprises a non-transitory computer readable storage medium. In some implementations, the memory 606 or alternatively the non-transitory computer readable storage medium stores the following programs, modules and data structures, or a subset thereof:

an operating system 610 (e.g., an embedded Linux operating system), which includes procedures for handling various basic system services and for performing hardware dependent tasks;

a network communication module 612 for connecting the computer system with a manufacturing machine via one or more network interfaces (wired or wireless);

a computing module 614 for executing programming instructions;

a controller 616 for controlling a manufacturing machine in accordance with the execution of programming instructions; and a user interaction module 618 for enabling a user to interact with the computer system 600.

One or more of the above identified elements may be stored in one or more of the previously mentioned memory devices, and correspond to a set of instructions for performing a function described above. The above identified modules or programs (e.g., sets of instructions) need not be implemented as separate software programs, procedures or modules, and thus various subsets of these modules may be combined or otherwise re-arranged in various implementations. In some implementations, the memory 606 optionally stores a subset of the modules and data structures identified above. Furthermore, the memory 606 may store additional modules and data structures not described above.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the implementation(s). In general, structures and functionality presented as separate components in the example configurations may be implemented as a combined structure or component. Similarly, structures and functionality presented as a single component may be implemented as separate components.

These and other variations, modifications, additions, and improvements fall within the scope of the implementation(s).

It will also be understood that, although the terms "first," "second," etc. may be used herein to describe various elements, these elements should not be limited by these terms. These terms are only used to distinguish one element from another. For example, a first opening could be termed a second opening, and, similarly, a second opening could be termed a first opening, without changing the meaning of the description, so long as all occurrences of the "first opening" is renamed consistently and all occurrences of the "second opening" is renamed consistently. The first opening and the second opening are both openings, but they are not the same openings.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

The foregoing description included example systems, methods, techniques, instruction sequences, and computing machine program products that embody illustrative implementations. For purposes of explanation, numerous specific details were set forth in order to provide an understanding of various implementations of the inventive subject matter. It will be evident, however, to those skilled in the art that implementations of the inventive subject matter may be practiced without these specific details. In general, well-known instruction instances, protocols, structures and techniques have not been shown in detail.

The foregoing description, for purpose of explanation, has been described with reference to specific implementations. However, the illustrative discussions above are not intended to be exhaustive or to limit the implementations to the precise forms disclosed. Many modifications and variations are possible in view of the above teachings. The implementations were chosen and described in order to best explain the principles and their practical applications, to thereby enable others skilled in the art to best utilize the implementations and various implementations with various modifications as are suited to the particular use contemplated.

What is claimed is:

1. A clippable whistle, comprising:

a whistle body having a first end and a second end located opposite the first end; and a clip attached to the whistle body, wherein the whistle body comprises:

a flat surface located under the clip;

a first opening located at the first end, the first opening configured to allow air flow to enter an inner portion of the whistle body; and a second opening located on the flat surface between the first end and the second end, the second opening configured to allow air flow to exit the whistle body, wherein the second opening is at least partially blocked by the clip to control direction of air flow coming out of the second opening;

wherein the clippable whistle is configured to generate a plurality of different sound tones in accordance with user finger movements around the clip and the second opening.

2. The clippable whistle of claim 1, wherein the first opening is unobstructed by the clip.

3. The clippable whistle of claim 1, wherein the second opening is positioned under the clip.

4. The clippable whistle of claim 1, wherein the second opening is the only opening to allow air flow to exit the whistle body.

5. The clippable whistle of claim 1, wherein the second opening defines a wedge shape having an opening wider than a width of the clip such that the clip partially blocks air flow exiting the second opening.

6. The clippable whistle of claim 5, wherein an amount and direction of air flow exiting the second opening can be controlled by finger movements around the clip and the second opening.

7. The clippable whistle of claim 1, wherein the clip includes a curved portion that at least partially blocks the one or more air flows traveling along an outer surface of the whistle body from the second opening traveling towards the first end.

8. The clippable whistle of claim 1, further comprising a glass breaker attached to the first end.

9. The clippable whistle of claim 8, wherein the glass breaker includes a detachable tip that defines a shape configured to expel glass debris away from a center of the tip when the glass breaker contacts glass.

10. The clippable whistle of claim 8, wherein the whistle body is mechanically separable from the glass breaker.

11. The clippable whistle of claim 1, further comprising a pen attached to the second end.

12. The clippable whistle of claim 11, wherein the whistle body is mechanically separable from the pen.

13. The clippable whistle of claim 11, wherein the pen includes one or more dialed length scales on a finger rest area of the pen.

14. The clippable whistle of claim 13, wherein the dialed length scale is machined with a diamond knurling texture.

15. The clippable whistle of claim 11, wherein the pen applies a bolt structure to control a position of ink refill.

16. The clippable whistle of claim 15, wherein the bolt structure is separable from the pen and is made of hard material such that it is capable of starting fire sparkles when being struck against a hard surface.

17. The clippable whistle of claim 15, wherein the bolt structure forms a seal at the second end of the whistle body such that all of the air flow is forced out of the second opening.

18. The clippable whistle of claim 17, wherein the first opening receives the airflow along a first direction, and the second opening is configured to allow the airflow to exit along a second direction that is opposite the first direction.

19. The clippable whistle of claim 1, wherein the flat surface under the clip is configured into multiple levels such that the space between the clip and the flat surface is capable of forming a tight grip on edges of various thicknesses.

20. The clippable whistle of claim 19, wherein the flat surface around the second opening includes two levels such that a first level closer to the first opening forms a narrower space with the clip's surface than a second level more distant from the first opening.

* * * * *